United States Patent [19]

Sasaki et al.

[11] Patent Number: 4,684,566

[45] Date of Patent: Aug. 4, 1987

[54] POLYESTER YARN AND FABRIC MADE OF THE SAME

[75] Inventors: Yoshiyuki Sasaki, Takatsuki; Katsuyuki Kasaoka, Ibaraki, both of Japan

[73] Assignee: Teijin Limited, Osaka, Japan

[21] Appl. No.: 812,246

[22] Filed: Dec. 23, 1985

[30] Foreign Application Priority Data

| | | | |
|---|---|---|---|
| Dec. 21, 1984 | [JP] | Japan | 59-270633 |
| Oct. 4, 1985 | [JP] | Japan | 60-220153 |
| Oct. 8, 1985 | [JP] | Japan | 60-222664 |

[51] Int. Cl.[4] ..... D03D 3/00

[52] U.S. Cl. ..... 428/224; 428/225; 428/229; 428/253; 428/257

[58] Field of Search ..... 428/221, 222, 224, 225, 428/152, 155, 182, 184, 185, 229, 253, 369, 371, 395, 364, 365, 257, 213, 229, 399

[56] References Cited

U.S. PATENT DOCUMENTS

| | | | |
|---|---|---|---|
| 4,209,559 | 6/1980 | Wada et al. | 428/224 |
| 4,416,934 | 11/1983 | Kimura et al. | 428/224 |

FOREIGN PATENT DOCUMENTS

| | | | |
|---|---|---|---|
| 050335 | 3/1977 | Japan | 428/222 |

*Primary Examiner*—James J. Bell

*Attorney, Agent, or Firm*—Burgess, Ryan & Wayne

[57] ABSTRACT

A polyester multi-filament yarn having uneven thickness along the length, comprising a bulged portion in which a part of filaments are separated or bulged out from the yarn surface, and at least a portion of the filament composing the bulged portion has a wrinkled area disposed intermittently along the length of the filament, each area being formed of a plurality of corrugations created by upheaval of the surface of the filament, each corrugation encircling substantially the entire periphery of the filament perpendicular to the axis of the filament. The yarn is suitably utilized for manufacturing a fabric having a raw silk touch.

9 Claims, 35 Drawing Figures

NO DYING UNEVENNESS

INCREASE OF YARN BULKINESS

CHANGE OF S-S CURVE (REDUCTION OF ELONGATION)

DETERIORATION BY ALKALI TREATMENT NOT CAUSED EVEN IN STARTING YARN SPUN AT LOW SPEED

POLYESTER YARN AND FABRIC MADE OF THE SAME

BACKGROUND OF THE INVENTION

1. Field of the Invention

The present invention relates to a novel polyester multi-filament yarn and a unique fabric made of the same. Particularly, it relates to an improvement of a polyester multi-filament yarn having uneven thickness and to a fabric made thereof having appearance and touch just like a spun silk fabric.

2. Description of the Related Arts

According to recent market needs, a fabric made of a polyester yarn having an improved touch resembling that of natural fibers, such as a silky touch, wooly touch, a cotton-like touch or a linen-like touch has been developed. However, a satisfactory product, especially, one having a raw silk touch has not been obtained.

An oldest woven fabric of polyester filaments is one formed by plain filaments. FIG. 2 is a microscope photograph showing in an enlarged manner the arrangement of filaments on the surface of this known fabric made of plain polyester yarns. As shown in FIG. 2, this fabric has an artificial touch of so-called synthetic fiber-like and has no bulkiness, and the fabric is slippery. Accordingly, the fabric is used for sport wears in which only the toughness is important or in the field of umbrellas or sheets.

As the product in which the defects of the above fabric are eliminated, there can be mentioned a silky fabric formed by a yarn having filaments which differ in shrinkability. Namely, this fabric is characterized in that filaments having a high shrinkability and filaments having a low shrinkability are mixed together and the woven fabric is made bulky by utilizing the difference of the shrinkability at the finishing step of the woven fabric, whereby softness and drape resembling those of silk are imparted to the fabric.

FIG. 3 is a microscope photograph showing in an enlarged manner the arrangement of filaments on the surface of the silky woven fabric formed by the above mixed yarn. As shown in FIG. 3, the single filaments on the surface are slightly bulky, but the individual single filaments are substantially in parallel to one another, and the fabric is still close to the fabric made of a plain filament yarn.

As the product in which manifestation of a wooly touch is intended, there can be mentioned a textured fabric. In this fabric, by imparting fine crimps to respective filaments, wool-like bulkiness and voluminousness are manifested. Since an artificial touch is still left in this fabric, there has been proposed a technique according to which two filament yarns differing in the elongation are simultaneously subjected to the texturizing treatment to form a false-twisted two-layer yarn and a woven fabric is formed by using such yarns. In this fabric, since respective filaments have crimps and they are meandering (migrating), the artificial rubbery touch inherent to the filament woven fabric is eliminated and the touch is made closer to the touch of wool.

FIG. 4 is a microscope photograph showing in an enlarged manner the arrangement of single filaments on the surface of the woven fabric formed by using the above-mentioned false-twisted two-layer yarns.

A woven fabric made of a Taslan (a registered trade mark of Du pont) yarn formed by compressed air texturizing has been developed. This woven fabric is characterized in that loops (closed loops) are formed in single filaments to impart a crispy feel and a cotton-like touch. Moreover, there has been developed a technique of imparting a rigidity by fusion-bonding single filaments to produce a linen-like touch.

FIG. 5 is a microscope photograph showing in an enlarged manner the arrangement of single filaments on the surface of a woven fabric of Taslan yarns. As shown in FIG. 5, loops formed in the single filaments are present on the surface of the woven fabric.

As is apparent from the foregoing description, touches resembling those of most of natural fibers such as silk, wool, cotton and linen can be manifested in polyesters, and therefore, polyester fibers are vigorously used in the field of outwears where these touches are required and polyester fibers are in full flourish at the present.

However, a raw silk touch has not been manifested in polyester fibers at all. A raw silk fabric is rather coarse and crispy but it has an elegant feel. Consumers' needs have been recently diversified and even this peculiar touch is now required. Under this background, we have conducted research with a view to develop a novel technique of manifesting this touch.

While, it is known that an uneven yarn can be obtained when an undrawn polyester yarn is incompletely drawn (see Japanese Examined Patent Publication No. 51-7207 and Japanese Unexamined Patent Publication No. 58-70711). In this uneven yarn, as the unevenness is stressed, characteristics such as touch or unique appearance are strongly manifested. However, if this unevenness is stressed, a lowly oriented undrawn portion is left and the handling property or physical performance is degraded. Accordingly, in a product in which the touch and appearance are strongly manifested, the physical performance is poor.

Of course, the idea of improving the physical performance of the uneven yarn is disclosed in Japanese Examined Patent Publication No. 51-7207, but the attained improvement is still insufficient. More specifically, although an uneven yarn having an elongation of 35 to 70%, in which the total denier is not uneven, is disclosed, the primary yield strength is 1.0 g/d and the shrinkage in boiling water is higher than 15% in this yarn. Thus, this yarn fails to satisfy recent needs of improvement of the quality in connection with the handling property and physical performance.

The present inventors found that the raw silk touch fabric can be obtained by further improving a polyester uneven yarn of the abovesaid type.

SUMMARY OF THE INVENTION

It is an object of the present invention to provide a polyester uneven yarn in which the above defects are eliminated and the physical characteristics and handling property are improved.

It is another object of the present invention to provide a polyester woven or knitted fabric which has a coarse and crispy touch and elegant feel of natural raw silk.

A first aspect of the present invention is a polyester multi-filament yarn of uneven thickness, comprising a single filament having such a thickness that a denier ratio of a thicker portion to a thinner portion is more than 2.0 along the length thereof, wherein said yarn has a ratio of P50 to Pmax of less than $\frac{1}{2}$, a primary yield strength of more than 1.2 g/d, and a breakage elongation of less than 33%, while P50 stands for a value corresponding to a period 50 cm on a spectrogram of the yarn obtained from a normal test of a Uster spectrograph, and Pmax stands for the maximum value thereof.

Such a yarn is obtainable by a method for producing a polyester multi-filament yarn of uneven thickness, according to the present invention, comprising steps of bringing a side of a polyester undrawn multi-filament yarn into frictional contact with a guiding member under a tension of a range from 0.2 g/d to 1.0 g/d to parallelize single filaments composing said undrawn yarn to each other, said undrawn yarn being spun under a spinning speed of 2000 m/min so as to have a double refraction of less than $13\times10^{-3}$ and an oil pick-up of less than 1.5%; drawing said undrawn yarn while heating it at a temperature of more than 55° C. above the glass transition temperature of the undrawn yarn and with a draw ratio of less than the natural draw ratio thereof, while avoiding that the stretching force and the heat are not concentrated to a particular point on said undrawn yarn; and winding the resultant yarn.

Further, a second aspect of the present invention is a fabric having appearance and touch like those of a fabric made of a spun silk yarn, wherein filaments composing said yarn are arranged in various orientations within the yarn structure so that a part thereof are crossed with each other, and wherein a part thereof have a longer entire length relative to the other so that the former part filaments are bulged out from the surface of said fabric and almost of said bulged filaments have no crimp and form no loop nor cut end fluff on the surface of said fabric, but undulate thereon with various orientation angles and curvatures, while a ratio of the number of said bulged filaments to that of the total filaments forming the fabric surface is within a range of from 3 to 5%.

A suitable yarn for composing the above fabric is a polyester multi-filament yarn of uneven thickness comprising a bulked portion, wherein a part of filaments is separated or bulged out from the yarn surface, and wherein at least a part of said filament composing said bulged portion has wrinkled areas disposed intermittently along the lengthwise direction, each area being formed of a plurality of corrugations created by or upheaval of the surface of the filament, each corrugation encircling substantially the entire periphery of said filament perpendicular to the axis of said filament.

BRIEF DESCRIPTION OF THE DRAWINGS

The other advantages and features of the present invention will be apparent from the description of the preferred embodiments with reference to the accompanying drawings: wherein.

DETAILED DESCRIPTION OF THE PREFERRED EMBODIMENTS

1. First Aspect of the Invention

Figure 2:
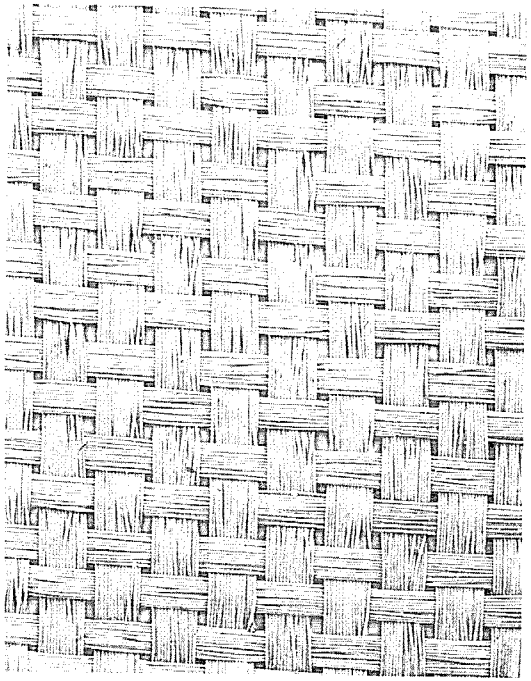
FIG. 2 is a microscope photograph showing in an enlarged manner the arrangement of filaments on the surface of a known polyester filament fabric.

A first aspect of the present invention is represented by a yarn.

We conducted research with a view to attaining the first object and to our great surprise, it was found that in a polyester uneven yarn, if the unevenness (thicker portion) is in the dispersed state and a certain condition is satisfied on the spectrogram in connection with the period of unevennesses, the primary yield strength and elongation are highly improved.

More specifically, in accordance with the present invention, as stated before, there are provided (1) a polyester uneven multifilament yarn comprising single filaments having a thickness unevenness in the longitudinal direction and a thick-to-thin ratio of at least 2.0, wherein the value (P50) obtained at a period of 50 cm on a spectrogram at the normal test of the yarn is less than $\frac{1}{2}$ of the maximum value (Pmax), the primary yield strength is at least 1.2 g/d and the elongation at break is not higher than 33%, and (2) a process for the preparation of a polyester uneven yarn, which comprises rubbing along the length under a tension of 0.2 to 1.0 g/d an undrawn polyester yarn melt-spun at a spinning speed lower than 2000 m/min, which has a double refraction lower than $13\times10^{-3}$ and an oiling agent pick-up (OPU) less than 1.5%, subjecting the undrawn yarn to uneven drawing at a draw ratio lower than the natural draw ratio without concentrated application of stress or concentrated heating while heating the yarn entirely at a temperature higher than the level higher by 55° C. than the glass transition temperature, and winding the drawn yarn.

By the term "spectrogram" referred to herein is meant one obtained by Uster's Spectrograph developed by Zelweger Ltd., Switzerland, and the measurement conditions are (1) the normal test, (2) the chart feed speed of 8 m/min and (3) the chart range of 25%.

When this Uster's Spectrograph is used in combination with an ordinary yarn evenness tester, the contents of the yarn unevenness can be promptly analyzed. Uster's Spectrograph is valuable for determining the unevenness pitch and is explained in detail in "Theory and Practice of Unevenness" (published by Textile Machinery Society of Japan), pages 255 through 372.

Figure 6:
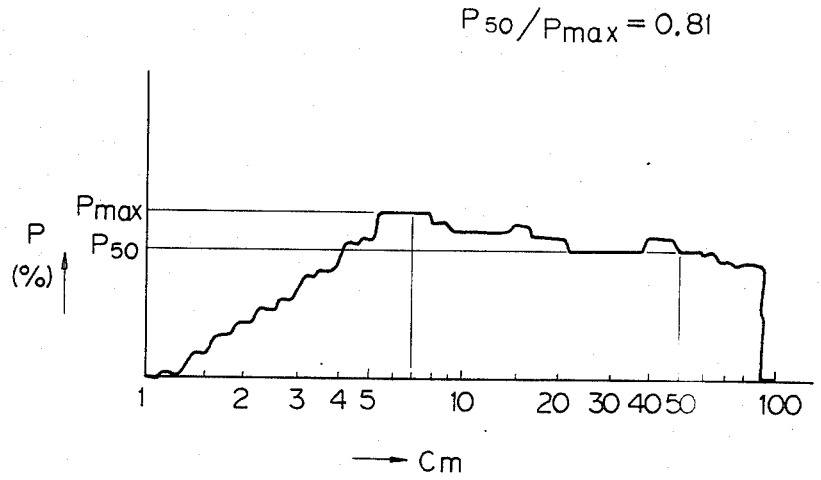
FIGS. 6 and 7 are spectrograms of conventional polyester uneven yarns.
Figure 7:
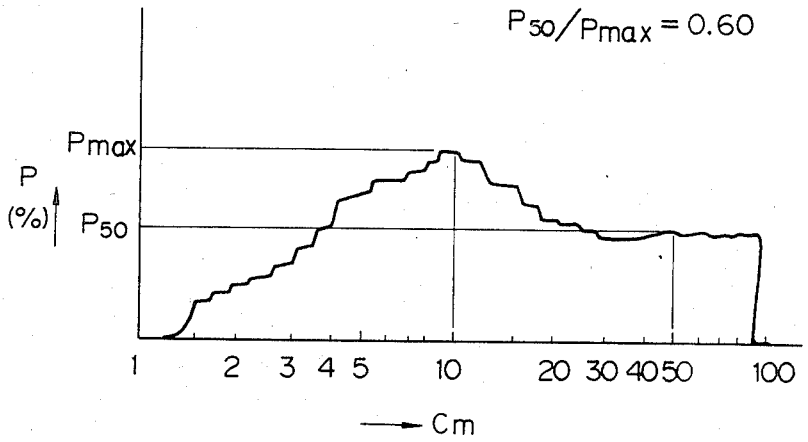
Figure 8:
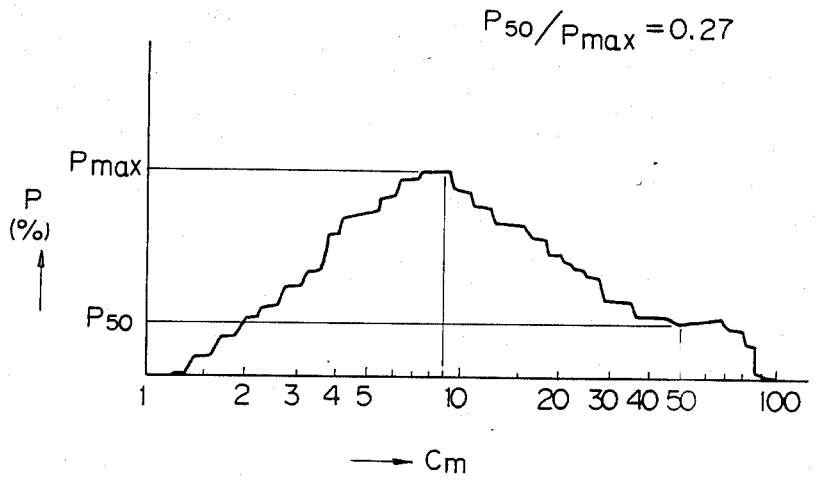
FIGS. 8 and 9 are spectrograms of polyester uneven yarns of the present invention.
Figure 9:
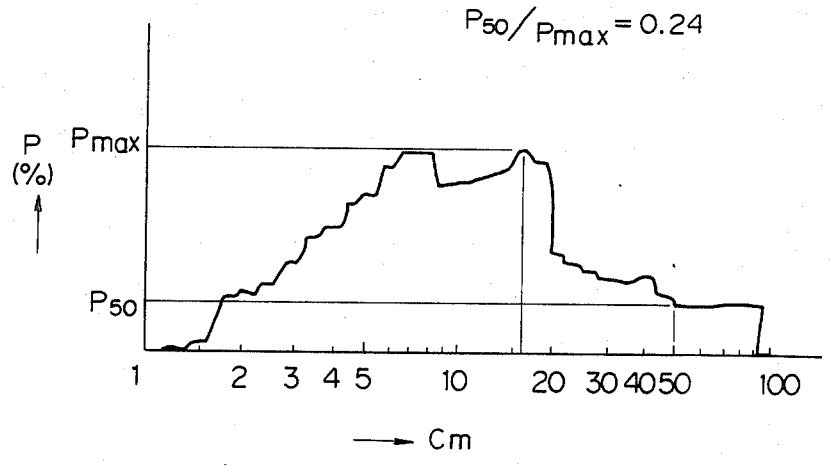

For facilitating the understanding, examples of the spectrograms of the conventional uneven yarns and the uneven yarns of the present invention are shown in FIGS. 6 through 9. FIG. 6 is chart of an uneven yarn obtained by tracing Example 1 of Japanese Examined Patent Publication No. 51-7207, FIG. 7 is a chart of an uneven yarn obtained by tracing the Example of Japanese Unexamined Patent Publication No. 58-70711. FIG. 8 is a chart of an uneven yarn obtained in Example 1 of the present invention given hereinafter, and FIG. 9 is a chart of an uneven yarn obtained in Example 2 of the present invention given hereinafter.

When FIGS. 6 and 7 (conventional techniques) are compared with FIGS. 8 and 9 (present invention), it is seen that there is found a prominent difference therebetween in the value of P50/Pmax defined in the present invention. Namely, the value of P50/Pmax exceeds $\frac{1}{2}$ (0.81 in FIG. 6 and 0.60 in FIG. 7) in the conventional yarns. In contrast, in the yarns of the present invention, the above-mentioned valve is apparently $\frac{1}{2}$ (0.27 in FIG. 8 and 0.24 in FIG. 9). This difference has significant influences on the handling property and mechanical characteristics of the uneven yarn. The reason has not been completely elucidated, but it is construed that the difference is due to the fact that while in case of FIGS. 6 and 7 (P50/Pmax $>\frac{1}{2}$), the yarn includes a long period unevenness, in case of FIGS. 8 and 9 (P50/Pmax$\leqq\frac{1}{2}$), the yarn does not substantially contain such a long period uneveness but thick portions are uniformly dispersed along the length.

Figure 10:
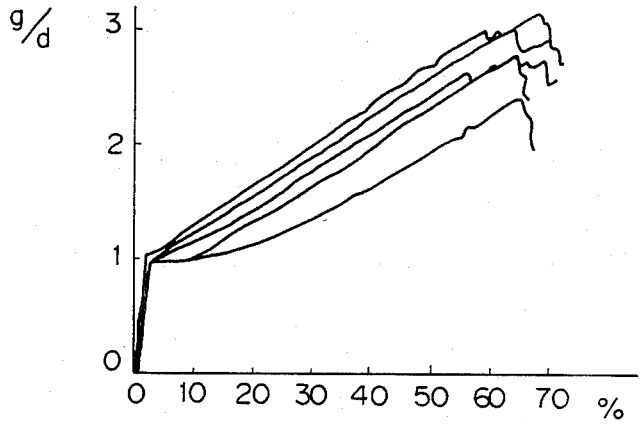
FIGS. 10 and 11 are stress-strain curves of the uneven yarns shown in FIGS. 6 and 7.
Figure 11:
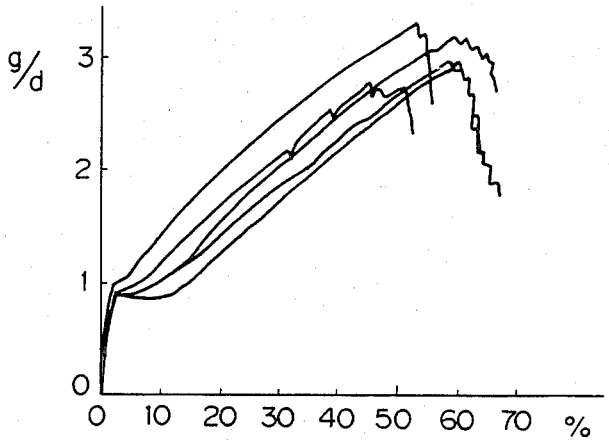
Figure 13:
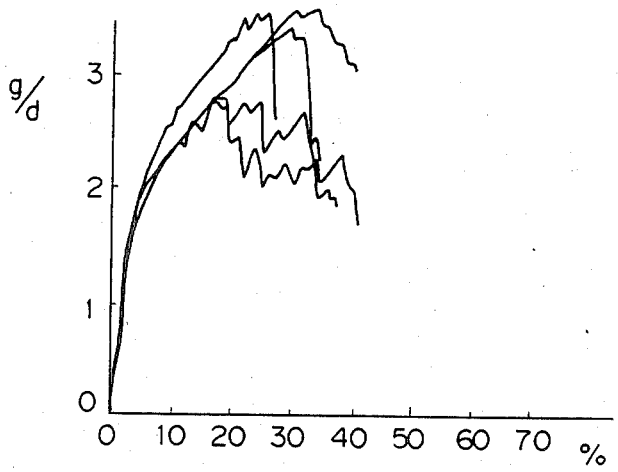

Stress-strain curves of the uneven yarns of FIGS. 6 through 9 are shown in FIGS. 10 and 13. Physical properties are summarized below from these FIGS. T,0110

As is apparent from Table 1, by reducing the value of P50/Pmax in the uneven yarn, the elongation, primary yield strength and boiling-off water shrinkage (BWS) can be highly improved even if the thickness unevenness is great. This is a novel finding. It has also been found that if the above-mentioned value is less than $\frac{1}{2}$, the elongation is not higher than 33% and the primary yield strength is at least 1.2 g/d in the uneven yarn.

This polyester uneven yarn can be obtained by adopting a special drawing manner of an undrawn polyester yarn. Namely, the drawing is performed in such a manner that the draw point is not concentrated in a particular portion of the respective filaments of the yarn so that the draw points on the individual single filaments are allowed to move independently. More specifically, the following cares are necessary for accomplishing this drawing:

(i) Not to apply a concentrated stress on the yarn.
(ii) Not to effect concentrated heating on the yarn.
(iii) To reduce the friction among filaments.
  (iii)-1 To reduce the oiling agent pick-up.
  (iii)-2 To open filaments.
(iv) To make the physical properties of filaments different.

These cares will now be described in detail. It is important that a lowly oriented undrawn polyester yarn should be drawn at such a low draw ratio as producing sufficient unevennesses while dispersing these unevenness more broadly along the length than in the conventional technique. For example, the spinning speed should be lower than 2000 m/min, preferably lower than 1500 m/min. A sufficient thick-to-thin ratio can be obtained if the orientation degree of the starting yarn is such that the double refraction is lower than $13\times10^{-3}$, preferably lower than $10\times10^{-3}$. It is preferred that the pick-up of the oiling agent applied during the spinning be less than 1.5%, more preferably less than 0.7%, and the denier and sectional shape are made different among the single filaments. For this purpose, it is preferred that the cooling effect on the as spun filaments by cold air be changed. Moreover, sufficient frictional contact of the yarn with a guiding member before drawing is effective. The tension in this step should be at least 0.2 g/d. Otherwise, the yarn is effectively drawn in the contact portion and speck-like unevennesses poor in the dispersibility are preliminarily given at this point, which unevenness are left to the end. Accordingly, it is important that the yarn should be in contact with the member so that substantial drawing should not be performed. From this viewpoint, it is preferred that the tension be up to 1.0 g/d. Moreover, during the drawing operation, concentrated application of the stress or concentrated heating should be avoided as much as possible so that the constant drawing point is not formed. For example, use of a pin or sharp bending is preferably avoided. Also, concentrated partial heating within a narrow range is not preferred. It is preferred that the yarn being drawn be heated as a whole in the state as flat as possible along a longer length, and that the heating temperature be higher than the level higher by 55° C. than the glass transition point of the starting yarn. If this temperature is too low, the effect of dispersing the neck point in a broad range during the drawing operation is reduced. Pre-heating of the starting yarn enhances the prevention of yarn wrapping around the roller. When the starting yarn is preliminarily heated, however, the preheating temperature should not greatly exceed this temperature so that the drawing points of the respective filaments are not concentrated. It is necessary that the drawing should be carried out at a draw ratio lower than the natural draw ratio of the starting yarn so that portions drawn at a low ratio are sufficiently left, whereby thick uneven portions are effectively formed also by dint of the low orientation degree of the starting yarn. If this unevenness-producing effect is insufficient, even when the performance is increased by improving the dispersibility, this increase becomes insignificant. In view of the foregoing, it is necessary that the thick portions should be contained in such a manner that the thick-to-thin ratio (the ratio of the largest denier to the smallest denier) should be at least 2.0, preferably at least 3.0. When the so-obtained uneven yarn is strongly interlaced, the lowly oriented portions in one filament are interlaced with the highly oriented portions in the other filament and the complementary relation is further reinforced. However, in order to obtain this effect, an interlacing degree is preferably higher than that sufficient to impart cohesiveness to an ordinary yarn, that is, to be, for example, at least 40, preferably 60 interlaced points per meter.

The polyester that is used in the present invention is not limited to a pure polyester, and even in case of a modified polyester containing a third component, the effects of the present invention can be sufficiently exerted.

Especially, a cationic dye dyable polyester is preferably usable for manufacturing even dyed products. Further, the polyester may contain titanium oxide of more than 1.0% by weight therein for improving the draping ability of the product. For achieving the same purpose, polybutylene terephthalate may be preferably utilized as a material polymer.

Figures 14A, 14B, 14C:
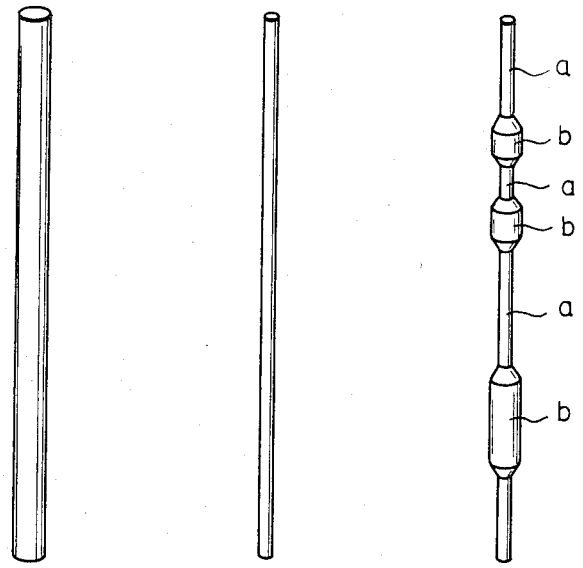
FIGS. 14*a*–14*c* is a model diagram illustrating generation of unevennesses by incomplete drawing.
Figure 15A:
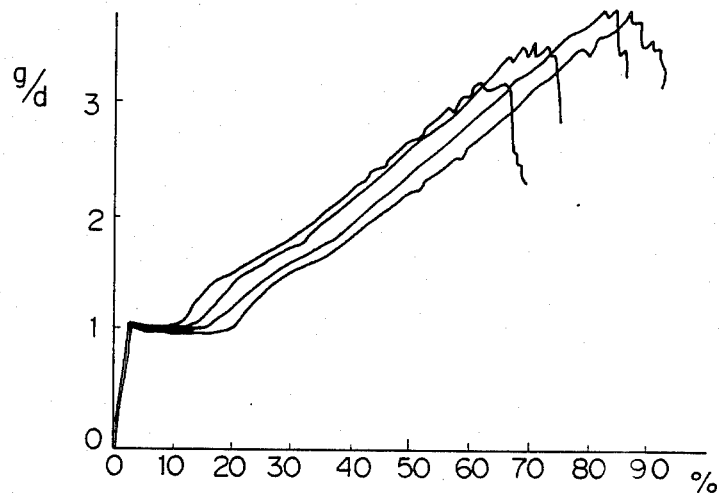
FIGS. 15*a*–15*b* is a model diagram illustrating the difference of the stress-strain curve between the conventional uneven yarn and the uneven yarn of the present invention.
Figure 15B:
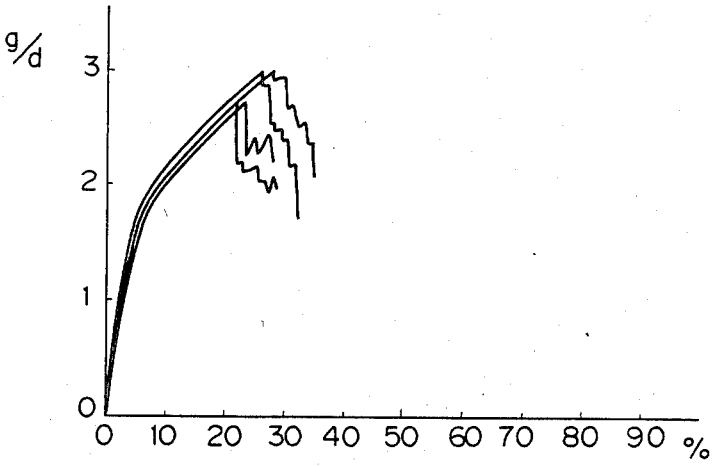
Figure 16A:
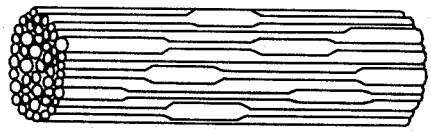
FIGS. 16*a*–16*b* is a model diagram showing the structure of the uneven yarn of the present invention.
Figure 16B:
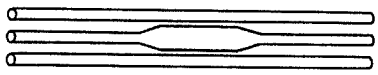

FIG. 14-(*a*) is a diagram illustrating an undrawn polyester filament. If this undrawn filament is drawn at a draw ratio higher than the natural draw ratio of the undrawn filament, a uniform fine drawn filament shown in FIG. 14-(*b*) is obtained. If the undrawn filament yarn is drawn at a draw ratio lower than the natural draw ratio, there is obtained an incompletely drawn filament which comprises completely drawn portions (a) and incompletely drawn portions (b) as shown in FIG. 14-(*c*). These incompletely drawn portions are densely dyed or have physical properties different from those of other portions, with the result that a special feel effect can be obtained. This effect has been known from old as the effect of a so-called thick-and-thin yarn. The incompletely drawn portions (b) obtained by this incomplete drawing will be further drawn if pulled. Accordingly, this drawn yarn is defective in dimensional stability. For example, FIG. 15-(*a*) is a stress-strain curve of an example of the conventional thick-and-thin yarn obtained by incomplete drawing at a low draw ratio. This curve flatly lies and the elongation is ordinarily very high. Generally, the elongation of a polyester filament yarn is about 20 to about 30% at highest, but if this yarn is incompletely drawn at the above-mentioned low draw, the elongation becomes higher than 35%, and as compared with the ordinary yarn, this incompletely drawn yarn is readily elongated during the use and the dimensional stability is degraded. Accordingly, the incompletely drawn yarn is inferior in the handling property and physical performance. Of course, this elongation may be reduced by increasing the draw ratio, but increase of the draw ratio results in loss of the desirable characteristics inherent to the incompletely drawn yarn. Accordingly, the incompletely drawn yarn inevitably has a fatal defect of a high elongation. Moreover, this incompletely drawn yarn is low in the primary yield strength and definite yielding appears, and therefore, the elastic recovery limit is readily exceeded by a small force and the handling property is further degraded. According to the present invention, these disadvantages can be overcome, and an uneven yarn which is satisfactory in the abovesaid effect caused by the incomplete drawing can be obtained without increase of the elongation. Namely, it has been found that if the content of long-period unevennesses is controlled below a certain level, that is, if the incompletely drawn portions are highly dispersed along the length of the filament so that the value of P50/Pmax is less than $\frac{1}{2}$, an incompletely drawn yarn having an elongation comparable to that of the completely drawn yarn is obtained, as shown in FIG. 15-(*a*). The reason of this effect has not been elucidated, but it is presumed that the effect will probably be attained because if incompletely drawn portions (b) are well distributed as shown in a model diagram of FIG. 16-(*a*), the completely drawn portion (a), which is not drawn any more, is always adjacent to the incompletely drawn portion (b) as shown in a model diagram of FIG. 16-(*b*) and, even under a tension, the portion (a) resists this tension and prevents the portion (b) from being elongated (in the drawings, the incompletely drawn portions are shown shorter for facilitating understanding but practically, they are often longer). Incidentally, the above-mentioned Japanese Examined Patent Publication No. 51-7207 proposes a process in which incompletely drawn portions are relatively well dispersed lengthwisely to obtain a pepper-and-salt effect or prevent yarn breakage during the heat treatment.

However, this conventional uneven yarn still has a high elongation and the problem caused by the high elongation is still left unsolved. According to the present invention, by greatly increasing the dispersion degree of the incompletely drawn portions and controlling the content of long-period unevennesses below a certain level, it becomes possible to produce a heretofore unexpected, novel yarn structure in which the elongation can be controlled to a level comparable to that of an ordinary drawn yarn even though incompletely drawn portions are contained. Of course, also in case of the uneven yarn of the present invention, if the draw ratio is increased or the obtained yarn is further stretched, the elongation can be reduced. However, in this case, the desirable effect of incomplete drawing is lost and performance peculiar to the incomplete drawing yarn also vanishes. One of the prominent characteristics of the present invention resides in that the elongation of the entire yarn can be reduced as described above even though incompletely drawn portions are contained.

Figure 17:
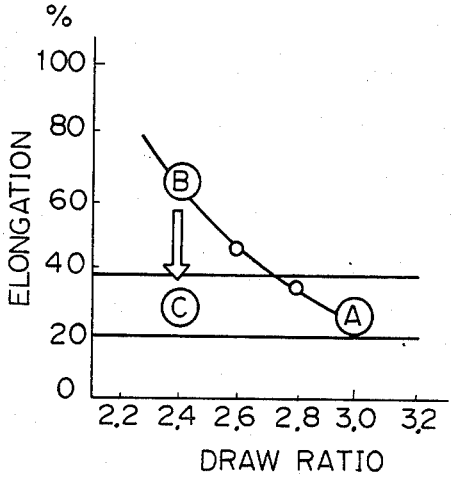
FIG. 17 is a diagram illustrating the relation between the draw ratio and the elongation of the yarn.

For example, with a polyester starting yarn melt-spun at a speed of about 1200 m/min, an ordinary drawn yarn having an elongation of about 30% is obtained by drawing it at a draw ratio of about 3.0. If the draw ratio is reduced, an incompletely drawn yarn is obtained. However, reduction of the draw ratio results in increase of the elongation according to the conventional technique, as shown in FIG. 17. In order to obtain an effective incompletely drawn yarn, it is necessary that the draw ratio should be lower than the natural draw ratio (2.5 in this case), and therefore, the elongation becomes considerably high. Ordinarily, the draw ratio corresponding to $0.8\times$(draw ratio for complete drawing), that is, 2.4 ($=3.0\times0.8$), is adopted. In this case, the resultant yarn (B) has a much higher elongation than the completely drawn yarn (A), as shown in FIG. 17. The elongation of a yarn that can be easily handled is generally about 20 to about 33%. Accordingly, the elongation of the yarn (B) is too high and handling of this yarn is difficult. In contrast, in the uneven yarn (C) of the present invention, the elongation is not different from that of the ordinary drawn yarn, even though uneven drawing is carried out at a low draw ratio. Furthermore, the primary yield strength of the uneven yarn of the present invention is at least 1.2 g/d, and no definite yielding point appears and the handling property is highly improved.

Figure 18:
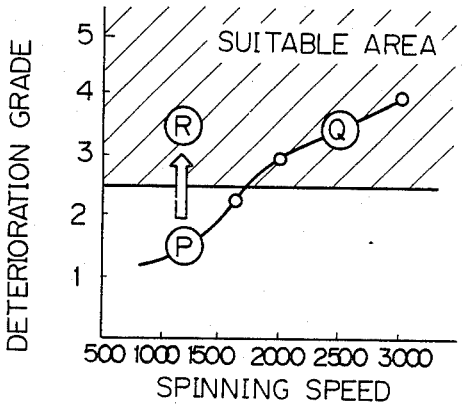
FIG. 18 is a diagram illustrating the relation between the spinning speed and the deterioration of strength.
Figure 19:
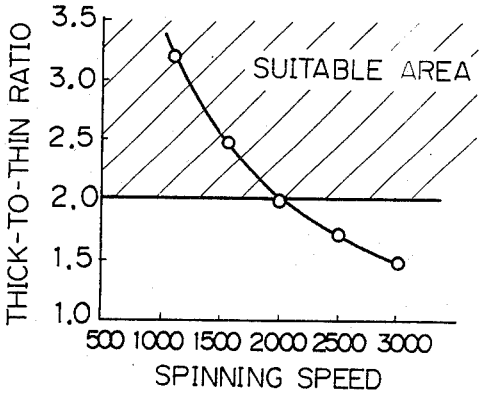
FIG. 19 is a diagram illustrating the relation between the spinning speed and the thick-to-thin ratio.

The same holds good also with respect to the spinning speed. The lower is the spinning speed, the lower is the molecular orientation degree of the undrawn yarn. Accordingly, if this undrawn yarn having a low orientation degree is subjected to uneven drawing, the difference between incompletely drawn portions and completely drawn portion becomes conspicuous and the effect of uneven drawing is high. However, the lowly oriented portions are weak, and hence, the handling property is bad. Accordingly, as means for avoiding this deterioration of strength, there is proposed a process in which the molecular orientation degree is increased by increasing the spinning speed and the resulting highly oriented yarn is subjected to uneven drawing (see Japanese Unexamined Patent Publication No. 50-18718). For example, if an uneven yarn is prepared from a starting yarn spun at an ordinary spinning speed of 1200 m/min, the deterioration of fiber strength is prominent when a woven fabric of this yarn is subjected to an alkali weight-reduction treatment, and the wet friction fastness of the dyed product is class 1 or 2, which product cannot be practically used, as indicated by (P) in FIG. 18. Therefore, according to the conventional technique, the spinning speed of the starting yarn is increased to increase the molecular orientation degree and avoid this strength deterioration, as indicated by (Q) in FIG. 18. However, if the spinning speed is thus increased, the draw ratio should inevitably be reduced, with the result that the thick-to-thin ratio in single filaments between incompletely drawn portions and completely drawn portions is reduced and the intended uneven drawing effect can hardly be attained. This difficulty is effectively eliminated unexpectedly from the conventional common sense according to the present invention by highly dispersing the unevennesses and controlling the content of long-period unevennesses below a certain level, and a product capable of resisting the strength deterioration by alkali treatment can be obtained from an undrawn yarn spun at an ordinary spinning speed, an indicated by (R) in FIG. 18. The reason has not been completely elucidated, but as described above with reference to the elongation, it is construded that completely drawn portions surround incompletely drawn portions to protect them.

Figure 22A:
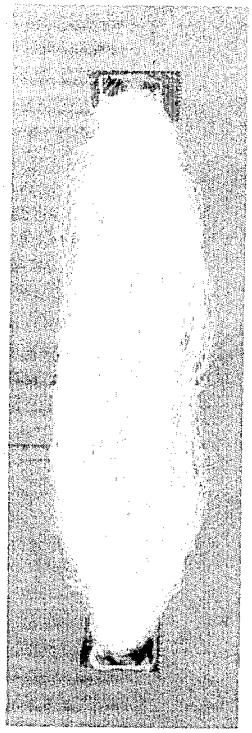
FIGS. 22*a*–22*b* is a photograph illustrating the state of the unevenly drawn yarn after shrinking in boiling water.
Figure 22B:
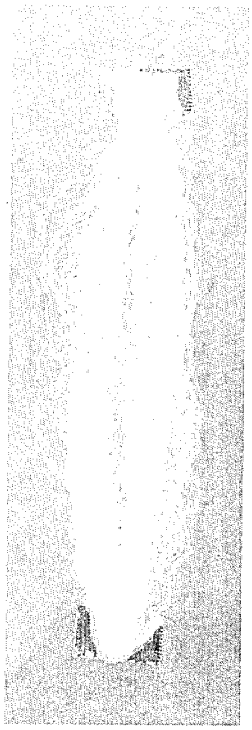

Furthermore, in the conventional uneven yarn, the surface of a woven fabric formed of this uneven yarn is crimped because of the difference of the shrinkage between incompletely drawn portions and completely drawn portions and creases are caused to appear by the so-called puff effect. However, if unevennesses are highly dispersed and the content of long-period unevennesses is reduced as in the present invention, no puff effect is manifested and a uniform bulky fabric surface is produced. This will be readily understood by comparing FIG. 22(*a*) with FIG. 22(*b*) illustrating an appearance of skeins formed of the conventional uneven yarn and that of the present invention, respectively. Moreover, in the conventional uneven yarn, the unevennesses appear as slubs on a fabric surface. Accordingly, the conventional uneven yarn is used only for the production of a fabric having a special appearance effect. In contrast, in the uneven yarn of the present invention, unevennesses do not definitely appear even though it contains lowly oriented portions, but only a special feel effect is prominently manifested. Accordingly, a material excellent in general-purpose properties can be provided according to the present invention.

The above-mentioned functions and effects of the present invention are summarized in FIG. 21.

Figure 20:
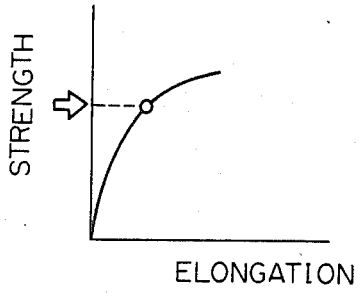
FIG. 20 is a diagram illustrating the primary yield point on the stress-strain curve.
Figure 21A:
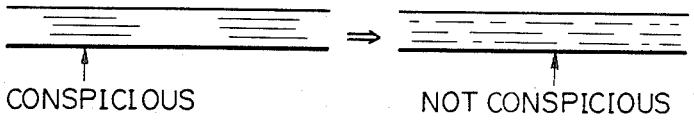
FIGS. 21*a*–21*d* is a diagram illustrating the effects and functions of the present invention.
Figure 21B:
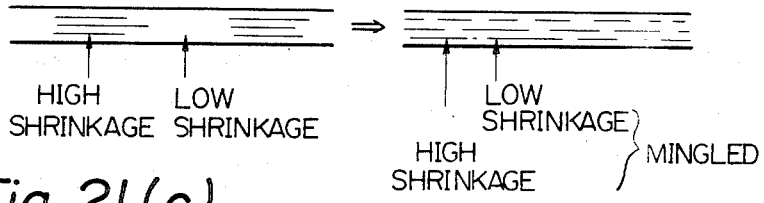
Figure 21C:
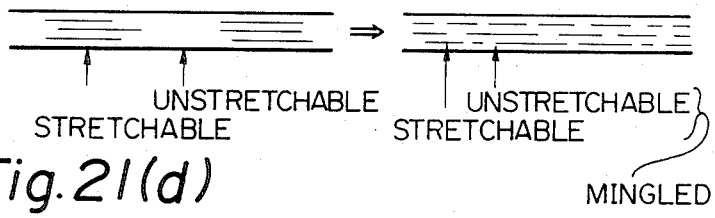
Figure 21D:
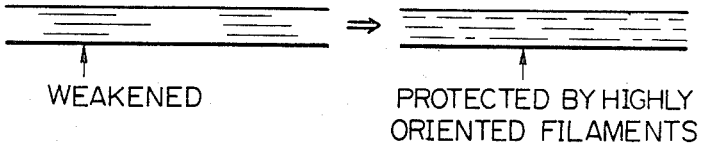

Incidentally, in the primary yield strength is indicated by the strength (indicated by an arrow in FIG. 20) at the bending point on the stress-strain curve as shown in FIG. 20, that is, the first point where the curve is bent at a minimum curvature. The stress-strain curve is determined under conditions of a sample length of 20 cm, a stretching speed of 100%/min and a sample number of 10 by using a Universal Tensile Tester (supplied by Instron Co.), and the elongation is determined based on the fracture point (the point where the strength is abruptly reduced), as in the conventional method.

By "the natural draw ratio" is meant the draw ratio at the point where abrupt rising from the flow state takes place when an undrawn yarn is stretched.

In general, undrawn portions are not completely identified from completely drawn portions, but the yarn is gradually changed between these portions. Accordingly, the thick-to-thin ratio may be changed according to the definition of the undrawn portions. However, according to the present invention, since the denier ratio of the maximum thickness filament to the minimum thickness filament in the yarn is adopted as the thick-to-thin ratio, as described hereinbefore, the value is clearly defined.

EXAMPLE 1

Figure 12:
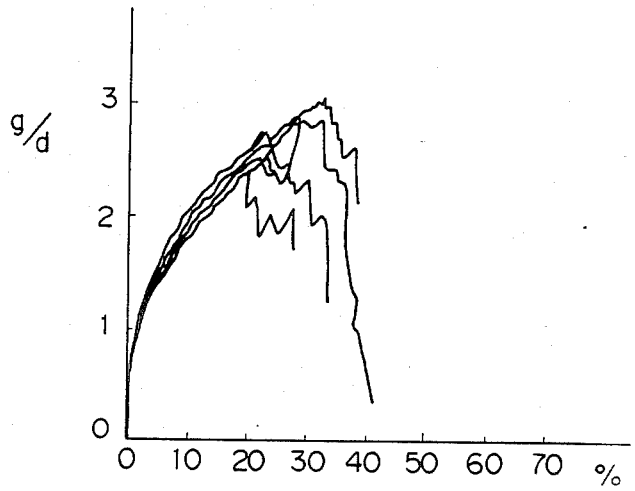
FIGS. 12 and 13 are stress-strain curves of the uneven yarns shown in FIGS. 8 and 9.

A fiber-forming polymer (having an intrinsic viscosity of 0.64) comprising ethylene terephthalate units as main recurring units was spun at a speed of 1270 m/min to obtain an undrawn yarn of 220 d/36 f having a double refraction of $8\times10^{-3}$, a natural draw ratio of 2.6 and a glass transition temperature of 67° C. This undrawn yarn was oiled at an OPU of 0.4% and was wound. For parallelizing filaments composing the yarn, the undrawn yarn was forcibly brought into contact with aluminum oxide rods, while running, having a diameter of 5 mm in a zigzag manner under a tension of 0.5 g/d, and subsequently, the yarn was pre-heated by a hot roller maintained at 50° C. and was drawn at a draw ratio of 2.5 by contacting it straightly and uniformly with a heating plate 6 having a flat surface and maintained at 160° C. carefully so that an acute contact angle was not produced. The resulting uneven yarn of 90 d/36 f was wound. The spectrogram and stress-strain curve of the obtained uneven yarn are shown in FIGS. 8 and 12, respectively (the physical properties are shown in No. 3 of Table 1). From the practical viewpoint, the handling property of the obtained uneven yarn was not substantially different from that of an ordinary drawn yarn. A twill fabric was prepared by using the so-obtained uneven yarn as warps and wefts and subjected to 20% alkali weight-reduction treatment to obtain a Viyella fabric. Such troubles as falling at knees and creeping were not caused in the obtained fabric, and the resistance to the strength deterioration by the alkali weight-reduction treatment was high and the wet friction fastness was class 3 to 4. Thus, it was confirmed that the obtained uneven yarn was comparable to an ordinary drawn yarn in the performance. Moreover, the feel characteristics such as warm feel, crispiness and drapy feel were very excellent because incompletely drawn filaments having a thick-to-thin ratio of at least 3 were contained in large quantities. Moreover, the defects of the conventional products concerning the handling property and performance were not observed and simultaneously, the product had very natural feel characteristics. Accordingly, it was confirmed that the uneven yarn could fully satisfy the two contradictory requirements simultaneously.

When the tension was reduced to 0.3 g/d at the parallelizing step, the obtained yarn had a P50/Pmax value of 0.41, an elongation of 29.5% and a primary yield strength of 1.4 g/d. If the OPU value was increased to 0.8%, the P50/Pmax value was 0.55, the elongation was 42.3% and the primary yield strength was 1.1 g/d, and the wet friction fastness was degraded to class 2 by the strength deterioration brought about the alkali weight-reduction treatment. In place of the abovesaid rubbing step using the rods arranged in a zigzag manner, the drawing operation was carried out while strongly rubbing the yarn against a plate at an acute angle, the P50/Pmax value was 0.78, the elongation was 54% and the primary yield strength was 1.0 g/d, and many kinks and crimps were observed in the obtained fabric and there was obtained a fancy fabric where a pattern of unevennesses was prominent.

EXAMPLE 2

Spinning and drawing were carried out in the same manner as described in Example 1 except that 0.5% of titanium oxide was incorporated into the starting polyethylene terephthalate polymer and, in a spinneret, the diameter of 12 holes among total 36 holes was increased to 1.5 times the diameter of other holes. Furthermore, between the drawing and winding process, the yarn was interlaced by 3% overfeeding under a pressure of 5 $kg/cm^2$ to form 47 interlaced points per meter. The spectrogram and stress-strain curve of the obtained yarn are shown in FIGS. 9 and 13, respectively (the physical properties are shown in No. 4 of Table 1). The yarn was strongly twisted at a twist number of 1600 twists per meter and the twists were set by a wet heat treatment at 90° C. A voile fabric was prepared by using the obtained yarn. Since the elongation of the yarn was low and the shrinkage in boiling water was not high, none of kinks, setting unevenness and weave bar were found on the fabric. Furthermore, a slub pattern owing to the uneven drawing was not found on the surface of the woven fabric. Moreover, since the filaments having a low molecular orientation were contained in large quantities, the woven fabric was conspicuously excellent over a conventional polyester voile fabric in feel characteristics such as repulsiveness, drape ability and bulkiness.

2. Second Aspect of the Invention

A second aspect of the present invention is represented by a fabric.

Figure 3:
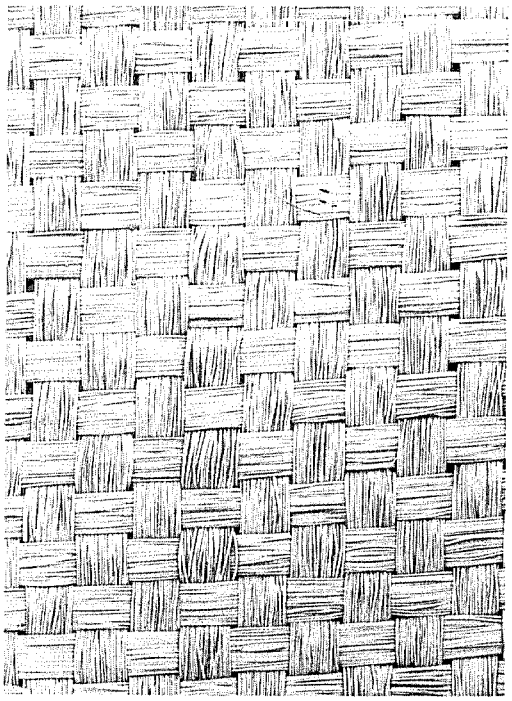
FIG. 3 is a microscope photograph showing in an enlarged manner the arrangement of filaments on the surface of a silky fabric formed by mixed yarn having filaments differing in the shrinkability.
Figure 5:
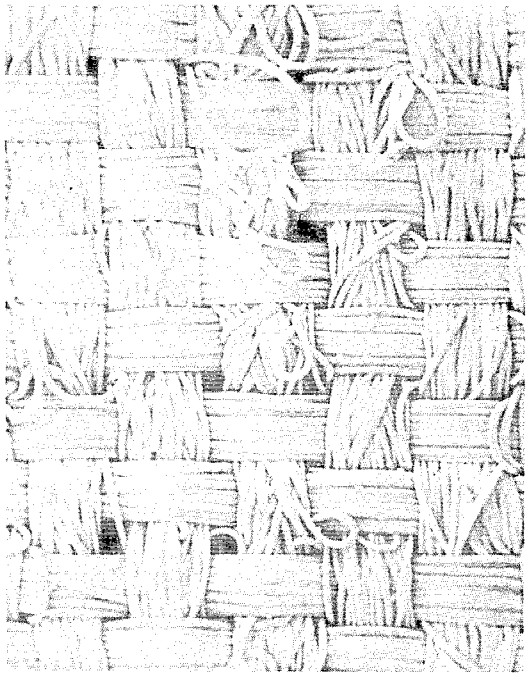
FIG. 5 is a microscope photograph showing in an enlarged manner the arrangement of single filaments on the surface of a fabric formed by using Taslan-processed yarns.
Figure 4:
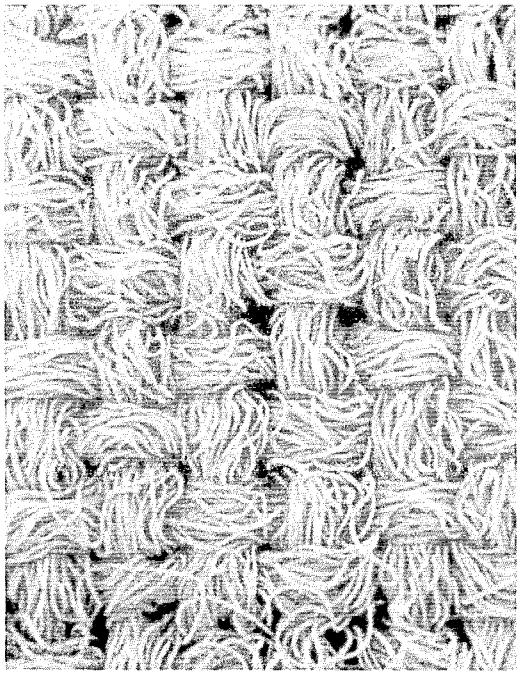
FIG. 4 is a microscope photograph showing in an enlarged manner the arrangement of single filaments on the surface of a fabric formed by using false-twisted two-layer yarns.

A characteristic feature of the woven or knitted fabric of the present invention is in that the fabric has an anisotropic property which is due to a kind of migration where constituent single filaments have different orientation angles and some of them intersect one another. If the constituent single filaments have substantially equal orientation angles, the fabric comes to have a monotonous feel resembling that of the conventional silky fabric and the fabric becomes too gentle, as shown in FIG. 3. What is more important is that parts of the single filaments have a length larger than that of other filaments and they are bulged on the surface of the fabric. Because of the presence of these bulged filaments, the touch of this portion of the fabric is delicately different from the touch of the ground yarn portion, resulting in manifestation of a coarse feel. However, it is important that the proportion of the bulged filaments should not be too large. If the proportion of the bulged filaments is too large, the fabric becomes too soft and the intended feel and touch cannot be obtained. In the present invention, the bulged filaments occupy a part of the surface of the fabric, and the remaining majority of the filaments are kept in the state of non-bulged filaments, whereby a raw silk touch, that is, a combination of a coarse touch and a silky touch, can be manifested. It is indispensable that the proportion of the bulged filaments should be up to 25%. Of course, if the proportion of the bulged filaments is too small, the intended effect cannot be attained. Accordingly, the proportion of the bulged filaments should be at least 3%.

If the bulged filaments are loopy, a crispy feel begins to appear. Although it is permissible that some of the bulged filaments have such loops, such loops should not be formed in the majority of the bulged filaments. If these filaments are bulged in the fluffy state, a warm feel is manifested, but the intended cool raw silk touch cannot be manifested. Accordingly, most of the single filaments should not be in the fluffy state where the filaments are broken and they have free ends. If the bulged filaments are crimped, a rubbery touch is manifested and the elegancy of the raw silk touch is lost. Accordingly, it is indispensable that the single filaments should not have crimps, but it is only permissible that they meander on the surface of the fabric at various orientation angles and curvatures.

Figure 1:
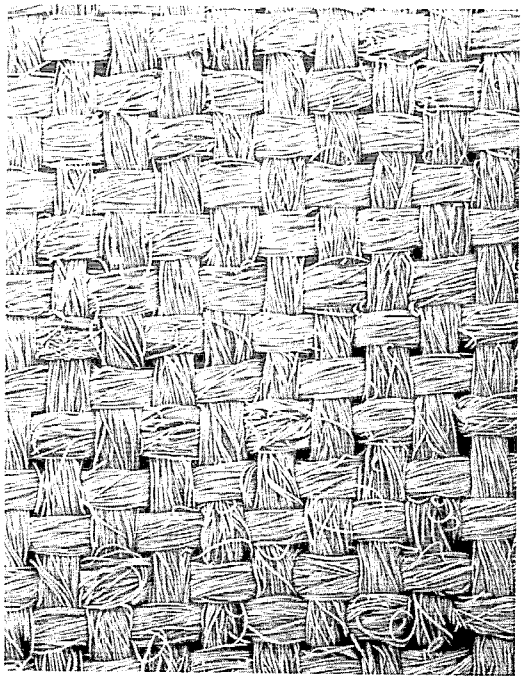
FIG. 1 is a microscope photograph showing in an enlarged manner the arrangement of single filaments on the surface of a fabric according to one embodiment of the present invention.

FIG. 1 is a microscope photograph showing in an enlarged manner the arrangement of single filaments on the surface of a woven fabric according to one embodiment of the present invention. The respective filaments are arranged at different angles and parts of the filaments are bulged on the surface of the fabric and the majority of the bulged filaments have not loops or fluffs and are not crimped.

The yarn according to the first aspect of the present invention is suitably utilized for the fabric of the second aspect.

Figure 23:
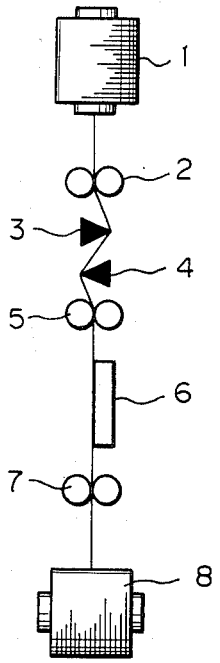
FIG. 23 is a diagram illustrating the steps of the process for preparing yarns according to the present invention.

FIG. 23 is a diagram showing the steps of this embodiment of the process for preparing the abovesaid yarn. Reference numeral 1 represents an undrawn polyester yarn of 120 d/36 f, which has been obtained by performing melt spinning at a speed of 1100 m/min, and this undrawn yarn is taken out by a roller 2 and lightly brought into frictional contact with members 3 and 4. Then, the undrawn yarn is lowly heated by a roller 5 and strongly heated by a heater 6 and is drawn at a low draw ratio between rollers 5 and 7 under heating to obtain a drawn yarn of 50 d/36 f in which filaments differing in the physical properties are mingled. The drawn yarn is wound on a winder 8.

As stated before, the undrawn yarn 1 is brought into contact with the members 3 and 4 before drawing. Very small amounts of an oligomer and an oiling agent adhere to the respective filaments of the undrawn yarn. Because of these oligomer and oiling agent or for other reason, the single filaments are bonded to one another, and when the undrawn yarn is brought into contact with the members 3 and 4, the single filaments are separated from one another. Accordingly, slight frictional contact is sufficient at this step. However, if the contact degree is too high, it is apprehended that the yarn will be substantially drawn. Accordingly, it is preferred that the tension in the contact be up to 1.0 g/d. In contrast, if the tension is too low, the intended effect cannot be attained. Therefore, it is preferred that the tension be at least 0.2 g/d in this step.

The undrawn yarn in which the single filaments have thus been separated is drawn between the rollers 5 and 7. Since the heating temperature of the roller 5 is low and the heating temperature of the heater 6 is high and since the draw ratio is low, the neck point (the point where the undrawn filaments are constricted and converted to drawn filaments) at the drawing step appears on the heater 6. If the temperature of the roller 5 is high, the undrawn yarn is greatly plasticized on the roller 5, and therefore, the neck point is concentrated on the roller 5. Accordingly, it is indispensable that the temperature of the roller 5 should not be too high and it is preferred that the temperature of the roller 5 be lower than the level higher by 20° C. than the glass transition point of the yarn. If the temperature of the heater 6 is too low, occurrence of necking on the heater 6 cannot be expected due to insufficient plasticization of the yarn. Accordingly, it is preferred that the temperature of the heater 6 be maintained at a level higher by at least 50° C. than the glass transition temperature. If the draw ratio is increased at the drawing step, the neck point is advanced forward and arrives at the roller 5. Therefore, the draw ratio should be lower than the ordinary draw ratio so that the neck point is located just on the heater 6 as stated before. Ordinarily, drawing is carried out at a draw ratio much higher than the natural draw ratio. However, in the present invention, it is preferred that the draw ratio be lower than the natural draw ratio. By this drawing operation, the neck point is allowed to be located just on the heater 6. However, since this position is determined according to the delicate balance among the foregoing conditions, the position of the neck point is unstable and shifts around on the heater 6. Since the undrawn yarn of the separated filaments is supplied to this heater 6, the neck point exerts different behaviors to the respective single filaments, and the neck points are formed at different portions on the heater 6 and these neck points vary among the filaments. Accordingly, in the obtained yarns, the single filaments having undrawn parts randomly come to have different physical properties, and the obtained yarn has a complicated structure as described before. If the drawn yarn is subjected to an air jetting interlacing treatment, the structure becomes more complicated.

When weaving or knitting is carried out by using the resultant yarn and the obtained fabric is strongly crumbled with hot water, the different physical properties of the respective filaments are manifested. Namely, some filaments are contracted and other filaments are elongated to wave on the surface of the fabric, whereby the characteristics of raw silk are manifested. Namely, in the structure of the fabric of the present invention, respective filaments have different orientation angles on the fabric surface, some of the filaments intersect one another, some of the filaments are bulged out from the surface of the fabric, and these bulged filaments have no loops or fluffs and are not crimped and they meander at various orientation angles and curvatures.

Of course, fabric composed solely of the abovementioned special-configuration yarns is most preferred because the intended touch can be manifested most easily. However, mix-weaving or mix-knitting may be carried out according to need. For example, in case of a woven fabric where wefts are strongly twisted, since the strongly twisted wefts make no substantial contribution to manifestation of the surface touch, ordinary polyester yarns can be used as the wefts. In short, appropriate combinations of yarns may be used according to intended uses.

At the step of finishing the greig fabric, it is necessary that the greig fabric should be sufficiently rubbed under heating. For example, it is preferred that the fabric be once rubbed with hot water and rubbed again under elevated temperature and elevated pressure conditions. If a high-pressure jet stream is used at the rubbing step, the effect is enhanced. The touch and feel effect of the present invention can be most easily manifested in a woven fabric, but a high effect is similarly attained also in a knitted fabric.

According to the abovesaid second aspect of the present invention, the polyester yarn incorporated into the fabric exhibits a unique change of appearance after the fabric has treated by the finishing processes including heat treatment. Due to this change, the touch of the polyester fabric can be improved.

That is, the yarn has a characteristic as defined in claim 8.

Figure 24:
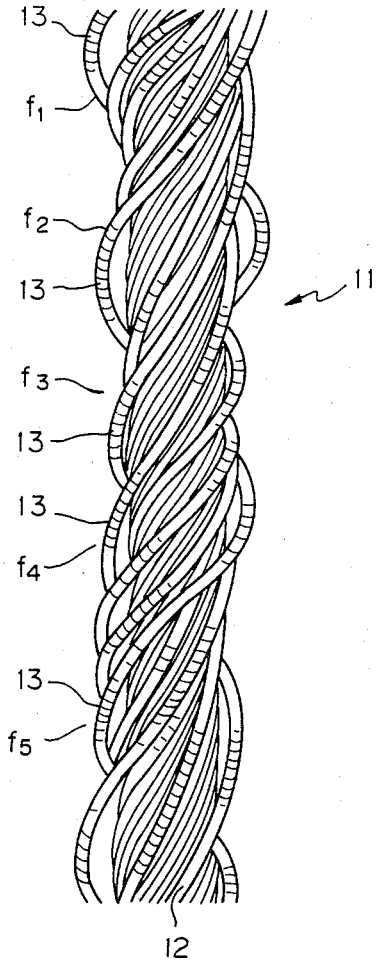
FIG. 24 is a side view showing the polyester multifilament yarn according to the present invention.
Figure 25A:
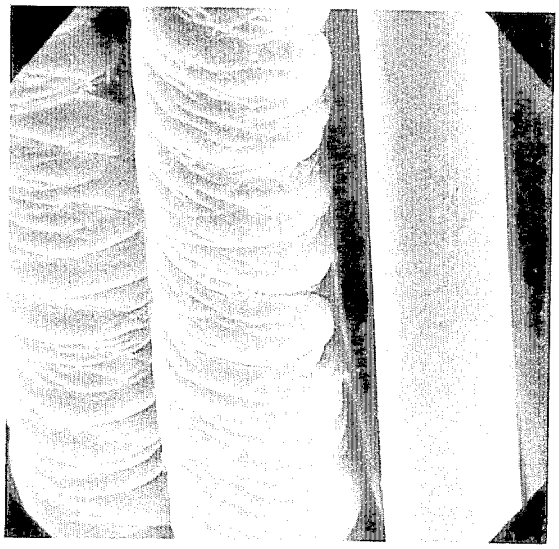
FIGS. 25*a*–25*b* is a perspective view of wrinkle-like corrugations formed by upheaval of the filament surfaces (electron microscope photograph; 1500 magnifications)
Figure 25B:
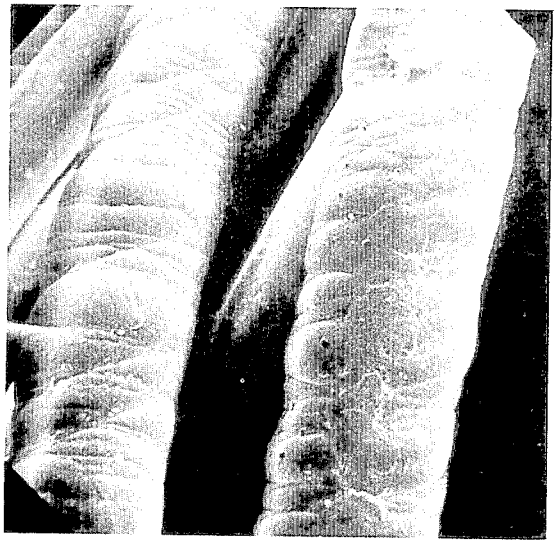

In FIG. 24, a side view of this yarn is illustrated. Reference numeral 1 represents a polyester multifilament yarn (Z-twisted yarn in the present embodiment), and among constituent filaments, filaments f1 through f5 are wound in the state free or derived from an ordinary twisted core portion 12. Furthermore, wrinkle-like corrugations 13 are present on the filaments f1 through f5. As shown in FIGS. 25-(*a*) and 25-(*b*) (electron microscope photographs; 1500 magnifications), these corrugations 13 are formed by ridges sequentially formed in the direction substantially orthogonal to the fiber axis. In this embodiment, the yarn is characterized in that the ridges are formed substantially around the entire periphery.

In the present invention, the effect of improving the surface touch can be attained by the wrinkle-like corrugations present in the filaments in addition to the touch and feel effect (improvement of the bulkiness) by the presence of the free or bulged filaments. From this viewpoint, it is preferred that the number of the free or bulged filaments be 3 to 25% of the total filament number. It is ideal that wrinkle-like corrugations will be formed on all of the filaments of the multifilament yarn, but this is practically difficult and it is not always possible to form corrugations on all the filaments. However, the surface touch of the yarn is drastically changed by imparting wrinkle-like corrugations to parts of filaments present on the peripheral portion of the yarn. In order to obtain the intended touch and feel effect, it is indispensable that the depth of the corrugations should be at least 0.08 μm. However, even if the depth of the corrugation is too large, the effect is not further enhanced but the fiber strength is reduced and the yarn drawing conditions become strict. Accordingly, the depth of the corrugation is up to 5 μm. If the pitch of the corrugation is too fine, the corrugation cannot be felt by the hand, and if the pitch is too coarse, convexties and concavities cannot be felt. Accordingly, it is preferred that the pitch of the corrugation be 0.4 to 25 μm. A circular cross-sectional filament is preferred for the corrugation, and sharp corrugation or deeply cut corrugation are not preferred because the durability is reduced.

Figure 26:
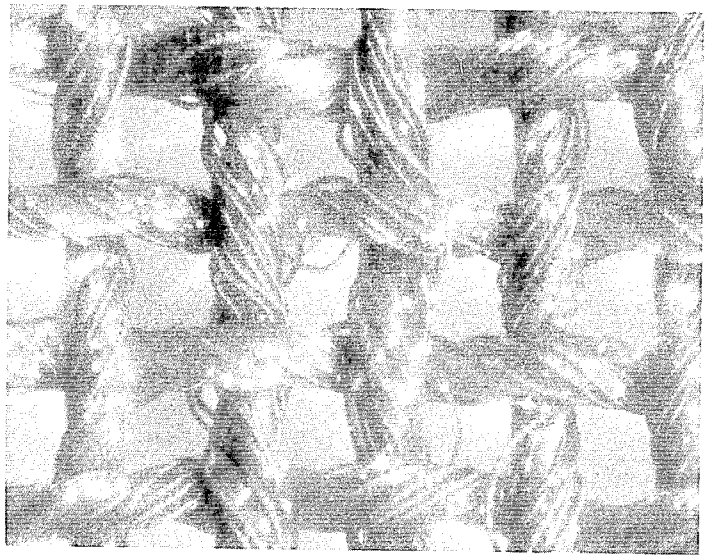
FIG. 26 is a plan view of a plain fabric composed of the multifilament yarn of the present invention (optical microscope photograph; 40 magnifications).

FIG. 26 illustrates an example of a woven fabric formed by using the polyester multifilament yarn of the present invention as warps and wefts (optical microscope photograph; 40 manifications). Free or bulged filaments are apparently present on the respective filament yarns.

As stated above, to develop a wrinkle-like corrugation on a surface of the filament, the yarn is subjected to a heat treatment while incorporated in a fabric. However, this heat treatment may be carried out before the yarn is incorporated into the fabric. One example of this heat treatment is 130° C. steaming for 30 min. and relaxing in boiling water following to the former.

According to this treatment, parts of the constituent filaments are set free or bulged out from the yarn surface, and simultaneously, the above-mentioned corrugations are manifested in the free or bulged filaments.

If only the boiling water treatment or the dry-heating treatment is carried out instead of the abovesaid heated steam-boiling water treatment, a certain treatment effect can be attained according to the heat or drawing history of the yarn, but in order to obtain a high effect, it is preferred that the heat treatment be repeated.

Of course, the yarn may be twisted and/or interlaced before formation into a woven or knitted fabric. In the case where the yarn is only interlaced, the filaments are readily separated in the yarn. Accordingly, it is preferred that the yarn be twisted.

The reason for occurrence of the corrugation on the filament surface is assumed as follows: If a yarn is not completely drawn as in the case where the yarn is drawn at a draw ratio lower than the natural draw ratio, the freedom of the movement of the molecules is large and therefore, the molecules are strongly shrunk by heating and the yarn comes to have a high shrinkage property uniformly. However, if the yarn is drawn at a draw ratio lower than the natural draw ratio at such a high temperature that this high shrinkage property is not produced, as in the case of the present invention, parts not completely oriented, like crystal nuclei, are formed in the fibers, and by subsequent strong heating or repetition thereof in some cases, these parts are grown to cause the upheaval. By the presence of these corrugations, the surface of the polyester yarn becomes hardly slippery, though the conventional polyester yarn is too smooth. That is, in the polyester yarn of the present invention, the slippery feel is reduced and a preferred touch is obtained.

As means for improving the surface touch, there have been developed a process, such as alkali treatment in which small holes are opened on the fiber surfaces. However, these processes are defective in that filaments are broken during the processing and dirts are intruded in holes or grooves to render the yarn blackish. According to the present invention, the surface touch can be improved without such defects. Therefore, the polyester yarn of the present invention is very tough, and handling is very easy. Moreover, the manufacturing cost can be reduced and the problem of poor hand inherent to the alkali weight-reduction treatment is not caused at all. For achieving the special effect, such as deep color shade, however, the alkali treatment may be adopted in the present invention.

Because of these characteristics, a slippery touch inherent to a polyester is not manifested in a fabric composed of the yarn of the present invention, but the fabric has a light and dry touch. Accordingly, the commercial value is increased in various products. Furthermore, since the corrugation on the fiber surfaces are very tough, they are not deformed during wearing and special care need not be taken during dyeing of a fabric so as to prevent the collapse of the corrugation.

On the other hand, in the present invention, since the alkali weight-reduction treatment is not necessary, the effect is especially high when the surface touch of a product having a strong nerve is improved.

EXAMPLE 3

A polyester polymer 460 d/48 f having ethylene terephthalate units as the main recurring units (containing 0.6% of titanium oxide, $\eta=0.62$) was melt-spun at 1100 m/min to obtain an undrawn yarn having a double refraction of $8\times10^{-3}$, a natural draw ratio of 2.5, a glass transition point of 67° C. The undrawn yarn was passed zigzag through three alumina guides under a tension of 0.5 g/d, and was then drawn at a draw ratio of 2.3 while it was heated at 180° C., whereby a drawn yarn of about 200 d/48 f was obtained. Then, the yarn was divided into 2 parts, and they were twisted at 800 t/m in the directions S and Z and heated by steam super-heated at 130° C. for about 30 minutes. Then, the two S- and Z-twisted yarns were alternately plain-woven. The woven fabric was heated while it was rubbed strongly by a boiling jet stream and the fabric was dry-heated and set at 160° C. Then, the fabric was dyed under 3 kg/cm$^2$ by a high-pressure dyeing machine and set at 160° C. to obtain a finished fabric. When the yarns of the obtained fabric were examined, it was found that about 5 filaments on the average (about 10% of all the filaments) were greatly bulged in the peripheral portion and they were free from the fiber surfaces as shown in FIG. 24, and that wrinkle-like corrugations having a depth of about 0.6 micron and a pitch of about 4 microns were formed. In connection with the feel and touch of the so-obtained woven fabric, even though the woven fabric was composed of the polyester, the slippery feel inherent to the polyester was greatly reduced and the fabric has a dry-and-light touch resembling that of nylon shalli, and nevertheless, the fabric had a good fitness to the hand and a soft repulsion. Accordingly, the fabric was a high-grade lady dress cloth excellent in the natural fiber feel. When the cloth was washed repeatedly 600 times, the wrinkle-like corrugations were not changed at all. It was therefore confirmed that the cloth was excellent in the practical durability.

We claim:

1. A fabric made of a synthetic multi-filament yarn having the appearance and hand like a fabric made of a spun silk yarn, wherein the filaments comprising said multi-filament yarn are arranged in various orientations within the yarn structure so that a part thereof are crossed with each other and wherein a first part of said filaments have a longer length relative to a second remaining part of the filaments of said yarn so that the first part filaments are bulged out from the surface of said fabric and said bulged filaments are essentially free of crimps, loops or cut end fluff on the surface of the fabric, but undulate thereon with various orientation angles and curvatures, wherein at least a portion of the first part filaments have wrinkled areas disposed intermittently along the length of the filament, each wrinkled area comprising a plurality of corrugations formed by protuberances on the surface of the filament, each corrugation encircling substantially the entire periphery of said filament perpendicular to the axis of said filament, and wherein a ratio of the number of said bulged out filaments to that of the total filaments forming the fabric surface is within a range of from 3 to 25%.

2. A fabric of claim 1, wherein said multi-filament yarn is a polyester multi-filament yarn.

3. A fabric of claim 2, wherein a ratio of the number of said separated or bulged filaments to that of the total filaments is within a range of from 3 to 10%.

4. A fabric of claim 2, wherein the depth of said corrugation is within a range of from 0.008 to 5 μm.

5. A fabric of claim 2, wherein the pitch of said corrugation is within a range of from 0.4 to 25 μm.

6. A fabric of claim 2, comprising corrugations not formed by a weight-reduction treatment with alkali.

7. A fabric of claim 2, formed from a yarn comprising single filaments having an uneven thickness in which a denier ratio of a thicker portion to a thinner portion is greater than 2.0 along the length thereof, wherein said yarn has a ratio of P50 to Pmax of less than 0.5, a primary yield strength greater than 1.2 gram/denier and a breakage elongation less than 33%, wherein P50 represents a value corresponding to a period of 50 cm on a spectrogram of the yarn obtained from a normal test of a Uster spectrograph, and Pmaz represents the maximum value thereof.

8. A fabric of claim 2, wherein the yarn comprising the fabric has a boiling off water shrinkage of less than 12%.

9. A fabric of claim 2, wherein the yarn comprising the fabric has an interlacing point greater than 40/m.

* * * * *